United States Patent [19]

Erickson et al.

[11] Patent Number: 4,851,017

[45] Date of Patent: Jul. 25, 1989

[54] RADIAL COOLING FAN FOR VACUUM CLEANER MOTOR

[75] Inventors: Roy O. Erickson; Steve Selewski, both of Cadillac; John Alberts, Marion, all of Mich.

[73] Assignee: Rexair, Inc., Troy, Mich.

[21] Appl. No.: 106,042

[22] Filed: Oct. 7, 1987

[51] Int. Cl.[4] ..... B01D 47/02

[52] U.S. Cl. ..... 55/256; 55/472

[58] Field of Search ..... 55/248, 250–254, 55/255, 256, 467, 470–473

[56] References Cited

U.S. PATENT DOCUMENTS

| | | | |
|---|---|---|---|
| 2,184,731 | 12/1939 | Brewer | 55/249 |
| 2,534,808 | 12/1948 | Bevington, Jr. et al. | 55/216 |
| 2,731,194 | 2/1953 | Kent | 55/276 |
| 2,954,095 | 9/1960 | Brock | 55/255 |
| 4,135,761 | 2/1979 | Nauta | 55/216 X |
| 4,547,206 | 10/1985 | Sovis et al. | 55/255 |
| 4,640,697 | 2/1987 | Erickson | 55/248 |
| 4,673,422 | 6/1987 | Tidwell | 55/248 |
| 4,693,734 | 9/1987 | Erickson | 55/248 |

*Primary Examiner*—Bernard Nozick

*Attorney, Agent, or Firm*—Harness, Dickey & Pierce

[57] ABSTRACT

A liquid bath vacuum cleaner includes a housing having an assembly for cleaning air. A cap assembly is operably connected to the housing. An inner canister is positioned within the cap assembly. A motor is mounted within the canister for rotating the assembly for cleaning air. The cap assembly includes an inlet for enabling ingress of cooling air into the cap assembly and an outlet for enabling egress of cooling air from the cap assembly. A motor cooling fan is connected to the motor for drawing cooling air through the inlet and for exhausting the cooling air radially from the motor cooling fan to cool the motor and exhaust the cooling air through the outlet.

9 Claims, 2 Drawing Sheets

RADIAL COOLING FAN FOR VACUUM CLEANER MOTOR

TECHNICAL FIELD

The subject invention relates to a vacuum cleaner, more particularly, to a liquid bath vacuum cleaner utilizing a cooling fan to cool the drive motor.

BACKGROUND AND SUMMARY OF THE INVENTION

In the past, liquid bath vacuum cleaners have been used to mix cooling air and cleaning air during the cleaning process. A typical example of a liquid bath vacuum cleaner is disclosed in U.S. Pat. No. 4,640,497, issued Feb. 3, 1987, in the name of Erickson, Jr. This patent discloses a liquid bath vacuum cleaner having a cooling air stream separated from its cleaning air stream to improve the cooling efficiency of the vacuum cleaner. The vacuum cleaner includes a separator at one end of the drive motor and a fan at the other end.

Such vacuum cleaners frequently utilize a cooling fan to exhaust cooling air axially from the fan. Since there is no radial component of the air leaving the fan, the air will take a longer time period to reach the drive motor. Also, there is less blade area on axial flow fans which limits the amount of airflow that can be exhausted to the drive motor. Furthermore, if a fan producing a larger air flow is to be installed in existing vacuum cleaners, typically, the vacuum cleaner would have to be modified to accommodate this fan.

Accordingly, the subject invention is a vacuum cleaner including a housing having an assembly for cleaning the air. A cap assembly is operably the cap assembly. A motor is mounted within the canister for rotating the assembly for cleaning the air. The cap assembly includes an inlet for enabling ingress of cooling air into the cap assembly and an outlet for enabling egress of cooling air from the cap assembly. A motor cooling fan is connected to the motor for drawing cooling air through the inlet and for exhausting the cooling air radially and axially from the motor cooling fan to cool the motor and exhaust the cooling air through the outlet.

The subject invention provides an additional radial component of cooling air flow. The cooling fan exhausts the air in a straight line path substantially parallel to the longitudinal axis of the motor drive shaft. Since the exhausted air flows directly to the motor, less time is required for the cooling air to reach the drive motor. This feature results in an improved efficiency in cooling the drive motor which may then be combined for even greater cooling efficiency. Finally, the subject invention produces an increased air flow and may be installed in existing vacuum cleaners without modifying the vacuum cleaner.

Other advantages of the present invention will be readily appreciated as the same becomes better understood by reference to the following detailed description when considered in connection with the accompanying drawings.

FIGURES IN THE DRAWINGS

DETAILED DESCRIPTION OF THE PREFERRED EMBODIMENT

Figure 1:
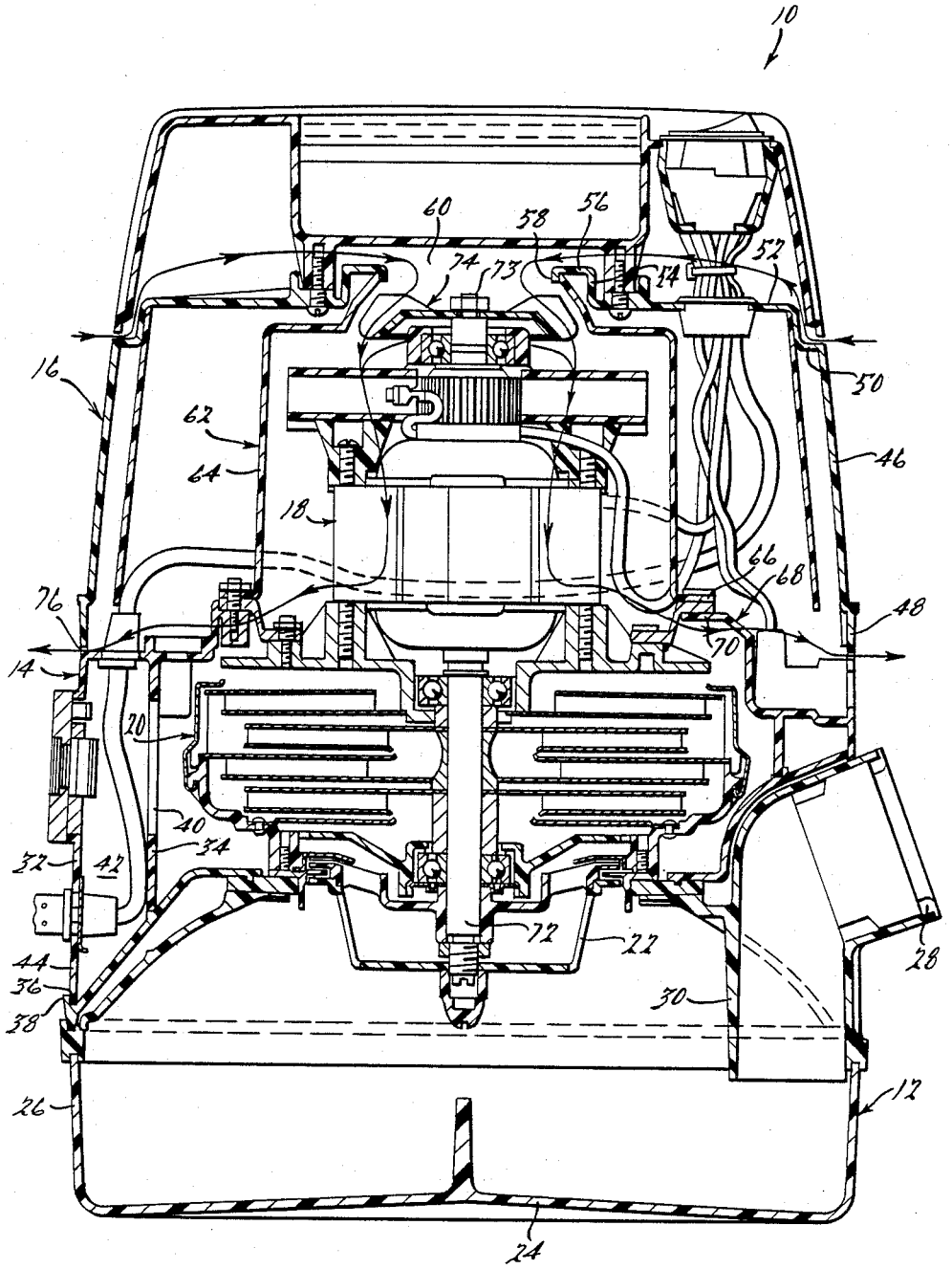
FIG. 1 is a side cross-sectional view partially in elevation of a vacuum cleaner of the subject invention.

A partial cross-sectional view of a vacuum cleaner according to the present invention is generally shown at 10 in FIG. 1. The vacuum cleaner 10 generally comprises a water pan assembly 12, a main housing assembly 14, a cap assembly 16, a motor assembly 18, a fan and stage housing assembly 20, a motor gasket (not shown) and a separator 22. The motor assembly 18 is mounted within the cap assembly 16. The fan and stage housing assembly 20 is mounted within the main housing assembly 14. The separator 22 is mounted adjacent to the fan and stage housing assembly 20 and is disposed within the water pan assembly 12 when the water pan assembly 12 is operably associated with the main housing assembly 14. The water pan assembly 12 is detachably connected to the main housing assembly 14 by conventional means, such as via a latch mechanism (not shown). The main housing assembly 14 is detachably connected to the cap assembly 16 by suitable fasteners (not shown).

The water pan assembly 12 includes a circular plate portion forming the base 24 of the pan assembly 12 and a continuous outer wall 26 forming the cylindrical portion thereof. A port 28 is formed in the outer wall 26 of the water pan assembly 12. A throat portion 30 is disposed adjacent to the port 28 and acts as a mechanism for directing the cleaning air flow through the pan assembly 12. Thus, as cleaning air enters into the vacuum cleaner 10, at the port 28, it is directed by the throat portion 30 toward the base 24 of the pan assembly 12.

The main housing assembly 14 includes a continuous outer wall 32 forming the outer concentric cylinder of the main housing 14. A second inner wall 34 forms an inner concentric cylinder of the main housing 14. A free depending end 36 of the outer wall 32 nests in a ledge 38 of the pan assembly 12. The inner wall 34 surrounds the fan and stage housing assembly 20. An aperture 40 in the inner wall 34 provides a passage for cleaning air passing out of the fan and stage housing assembly 20 into the main housing assembly cavity 42. The cleaning air then exits the cavity 42 through a plurality of apertures 44 in the outer wall 32 into the ambient air.

The cap assembly 16 includes a continuous outer wall 46 forming the outer casing of the cylindrical cap assembly 16. The outer wall 46 has its free depending end 48 in a nesting relationship with the main housing assembly 14. The top of the cap assembly 16 is defined by an annular flange 50 extending from the outer wall 46, a radially inward flange 52 extending from the annular flange 50, a second annular flange 54 extending from the radially inward flange 52, a second radially inward flange 56 extending from the second annular flange 54, and a lip 58 depending from the second radially inward flange 56. The second axially inward flange 56 and lip 58 form an inlet 60 in the cap assembly 16. The inlet 60 provides a passageway for cooling air into the cap assembly 16.

An inner canister 62 surrounds the motor assembly 18 and is mounted within the cap assembly 16. A continuous wall 64 forms the cylindrical portion of the inner canister 62. A radially outward flange 66 nests upon a mounting support ring 68 and flange 70 for securing the inner canister 62 and mounting support ring 68 to the main housing assembly 64.

FIG. 1 illustrates a cross-section of the fan and stage housing 20 and motor 18 assemblies. The detailed description of suitable fan and motor assemblies are described in Applicant's co-pending application entitled "Improved Air Blower Assembly for Vacuum Cleaners", U.S. patent application Ser. No. 782,510, filed Oct. 1, 1985 and herein incorporated by reference. The fan and stage housing assembly 20 is supported on the pan assembly 12 by a motor gasket (not shown) and is connected to one end of the motor assembly 18 about the drive shaft 72 thereof.

The separator 22 is also connected to the drive shaft 72 of the motor assembly 18. The detailed description of the separator 22 and components associated therewith are described in U.S. Pat. No. 4,640,697, issued Feb. 3, 1987, to Erickson, Jr. and herein incorporated by reference.

Figure 2:
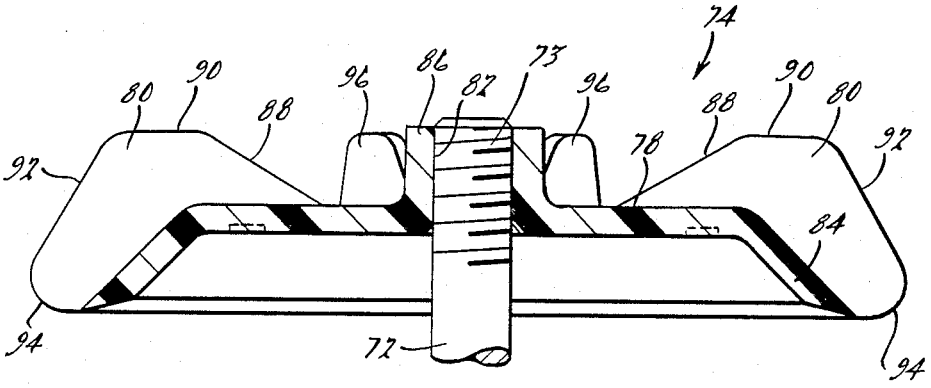
FIG. 2 is a sectional view of the motor cooling fan of the preferred embodiment of FIG. 1.

The vacuum cleaner 10 further includes a motor cooling fan generally indicated at 74, connected to the other end 73 of the drive shaft 72 of the motor assembly 18 for drawing cooling air through the inlet 60 and for exhausting the cooling air radially and axially or directing from the motor cooling fan 74 to cool the motor assembly 18 and exhaust the cooling air through the outlet 76 in the cap assembly 16. As illustrated in FIG. 2, the motor cooling fan 74 comprises a fan body 78 having a plurality of blades 80 for exhausting the cooling air radially and axially from the fan body 78. The blades 80 extend radially away from and axially toward the motor assembly 18. The fan body 78 includes a cylindrical bore 82 centrally disposed in a boss 86 therein and extending outwardly away from the motor assembly 18. The fan body 78 is planar and has a peripheral flange 84 extending radially and axially outward and radially toward the motor assembly 18. The blades 80 extend radiallly along the fan body 78 and radially and axially along the peripheral flange 84. The bore 82 is threaded for engagement with the threaded end 73 of the shaft 72 of the motor assembly 18, as shown in FIG. 1.

As illustrated in FIG. 2, the fan body 78 extends radially away in a plane from the longitudinal axis of the drive shaft 72. The peripheral flange 84 at the end of the fan body 78 extends radially outward and axially toward the motor assembly 18. The blades 80 are radially sapced from the bore 82 and have an inclined portion 88 extending radially outward and axially away from the motor assembly 18. A planar portion 90 extends radially outward at the end of the inclined portion 88. A second inclined portion 92 extends radially outward and axially toward the motor assembly 18. An arcuate portion 92 is formed at the end of the second inclined portion 92. A plurality of ribs 96 are circumferentially spaced about the boss 86. The ribs 96 extend radially outward and radially away from the motor assembly 18. The ribs 96 have a generally trapezoidal configuration.

Figure 3:
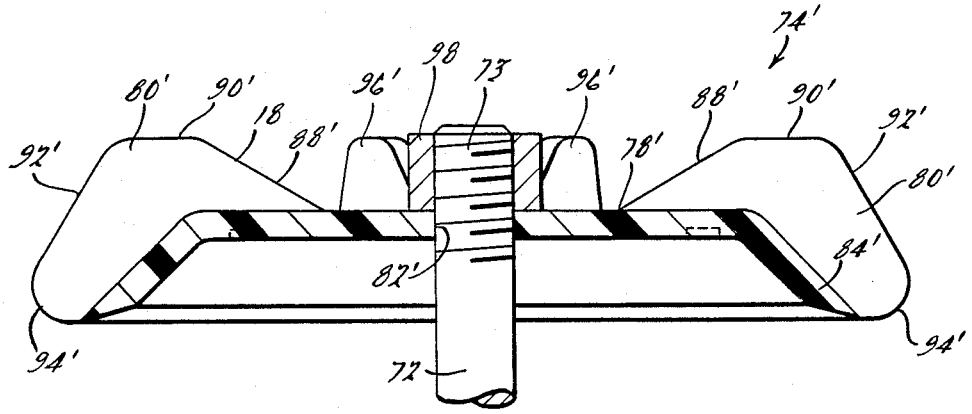
FIG. 3 is a sectional view of an alternate embodiment of the motor cooling fan of FIG. 1.

As illustrated in FIG. 3, an alternate embodiment of the motor cooling fan 74' is similar to the preferred embodiment 74, wherein like parts have like prime numerals. The motor cooling fan 74' has a bore 82' communicating through the fan body 78'. The threaded end 73 of the drive shaft 72 extends through the bore 82' and has a nut 98 threadably engageable with the threaded end 73 to secure the fan 74 to the drive shaft 72.

In operation, cleaning air enters the pan assembly 12 through the port 28. The throat portion 30 directs the cleaning air into the liquid in the pan assembly 12. The separator 22, already in rotation, directs dirt and dust particles into the liquid while drawing cleaning air into the fan and stage housing assembly 20. Cleaning air, drawn into the fan and stage housing assembly 20, passes through a plurality of fan stages, and then passes out of the fan and stage housing assembly 20 through a plurality of apertures. The cleaning air then enters the main assembly inner cavity 42, passes through the inner wall opening 40 into the main housing assembly cavity 42, and exits the cavity 42 through a plurality of apertures 36 in the main housing 14 into the ambient air.

The cooling air enters the cap assembly through the inlet 60 and into the inner canister 62 to cool the motor assembly 18. More specifically, the cooling air enters the inlet 60 and passes to the cooling motor fan 74. The cooling motor fan 74 exhausts the cooling air radially and axially through the motor cooling an 74 toward the motor assembly 18 to cool the motor assembly 18. The cooling air exits through a gap into the cap asembly cavity. The cooling air then exits the capassembly 16 through an outlet or plurality of slits 76 into the ambient air. Thus, the cooling air is separated from the the cleaning air in the present invention throughout operation of the vacuum cleaner 10.

The invention has been described in an illustrative manner, and it is to be understood that the terminology which has been used is intended to be in the nature of woods of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A vacuum cleaner comprising:

a first housing including an inlet and outlet, means for cleaning air intermediate said inlet and outlet, said cleaning means including fan means for moving cleaning air from said inlet to said outlet;

a second housing including inlet means for enabling ingress of cooling air into said second housing, and outlet means for enabling egress of cooling air from said second housing;

motor means mounted within said second housing for rotating a shaft connected at one end to said fan means within said first housing;

a third housing surrounding said motor means and positioned within said second housing for defining an air flow path around said motor means and said third housing having openings adjacent said inlet means and outlet means of said second housing for enabling passage of cooling air through said third housing such that cooling air is drawn into said third housing through said second housing inlet means and exits said third housing through said second housing outlet means; and cooling fan means connected to the other end of the shaft of said motor means for drawing cooling air through said inlet means for exhausting the cooling air radially and axially from said cooling fan means to cool said motor means and exhaust the cooling air through said outlet means, said fan means being adjacent said second housing inlet and comprised of a plate extending radially outward from and positioned substantially transverse in a horizontal plane to said shaft of said motor means and having a plurality of blades for exhausting the cooling air radially and axially from said plate, said blades extending from said plate.

2. A liquid bath vacuum cleaner comprising:

a pan housing for containing a liquid bath including an inlet and outlet, means for cleaning air intermediate said inlet and outlet, said cleaning means including fan means for moving cleaning air from said inlet to said outlet;

a first housing operably connected to said pan housing and including inlet means for enabling ingress of cooling air into said first housing, and outlet means for enabling egress of cooling air from said first housing;

motor means mounted within said first housing for rotating a shaft connected at one end to said fan means within said pan housing;

said first housing surrounding said motor means and defining an airflow path around said motor means, said inlet means and outlet means of said first housing enabling passage of cooling air through said first housing such that cooling air is drawn through said inlet means and exits said outlet means; and cooling fan means connected to the other end of the shaft of said motor means for drawing cooling air through said inlet means for exhausting the cooling air radially and axially from said cooling fan means to cool said motor means and exhaust the cooling air through said outlet means, said fan means being adjacent said first housing inlet and comprised of a plate extending radially outward from and positioned substantially transverse in a horizontal plane to said shaft of said motor means and a plurality of blades for exhausting the cooling air radially and axially from said plate, said blades extending from said plate.

3. A liquid bath vacuum cleaner as set forth in claim 2 further characterized by said blades extending axially from and radially toward said motor means.

4. A liquid bath vacuum cleaner as set forth in claim 3 further characterized by said plate including an aperture centrally disposed therein enabling said shaft to pass therethrough.

5. A liquid bath vacuum cleaner as set forth in claim 4 further characterized by said plate being planar and having a peripheral flange extending axially outward and radially toward said motor means.

6. A liquid bath vacuum cleaner as set forth in claim 5 further characterized by said blades extending axially along said plate and radially and axially along said peripheral flange.

7. A liquid bath vacuum cleaner as set forth in claim 6 further characterized by a boss connected to said plate and extending axially away from said motor means, said aperture communicating through said boss.

8. A liquid bath vacuum cleaner as set forth in claim 7 including a plurality of ribs circumferentially spaced about said boss and extending radially away from said motor means.

9. A liquid bath vacuum cleaner comprising:

a pan housing for containing a liquid bath including an inlet and outlet, means for cleaning air intermediate said inlet and outlet, said cleaning means including fan means for moving cleaning air from said inlet to said outlet;

a first housing operably connected to said pan housing and including inlet means for enabling ingress of cooling air into said first housing, and outlet means for enabling egress of cooling air from said first housing;

motor means mounted within said first housing for rotating a shaft connected at one end to said fan means within said pan housing;

a second housing surrounding said motor means and positioned within said first housing for defining an airflow path around said motor means and said second housing having openings adjacent said inlet means and outlet means of said first housing enabling passage of cooling air through said second housing such that cooling air is drawn into said second housing through said first housing inlet means and exits said second housing through said first housing outlet means; and cooling fan means connected to the other end of the shaft of said motor means for drawing cooling air through said first housing inlet means for exhausting the cooling air radially and axially from said cooling fan means to cool said motor means and exhaust the cooling air through said first housing outlet means, said fan means being adjacent said second housing inlet and comprised of a plate extending radially outward from and positioned substantially transverse in a horizontal plane to said shaft of said motor means and a peripheral flange extending from said plate to provide said plate with an inverted bowl shape and a plurality of blades for exhausting the cooling air radially and axially from said plate, said blades extending from said plate and said flange.

* * * * *